US009277333B2

(12) United States Patent
Aubreville et al.

(10) Patent No.: US 9,277,333 B2
(45) Date of Patent: Mar. 1, 2016

(54) METHOD FOR ADJUSTING THE USEFUL SIGNAL IN BINAURAL HEARING AID SYSTEMS AND HEARING AID SYSTEM

(71) Applicant: SIVANTOS PTE. LTD., Singapore (SG)

(72) Inventors: Marc Aubreville, Nuremberg (DE); Eghart Fischer, Schwabach (DE); Homayoun Kamkar Parsi, Erlangen (DE); Walter Kellermann, Eckental (DE); Stefan Meier, Nuremberg (DE); Henning Puder, Erlangen (DE); Klaus Reindl, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/257,151

(22) Filed: Apr. 21, 2014

(65) Prior Publication Data

US 2014/0314259 A1 Oct. 23, 2014

(30) Foreign Application Priority Data

Apr. 19, 2013 (DE) ..... 10 2013 207 161

(51) Int. Cl.
*H04R 25/00* (2006.01)

(52) U.S. Cl.
CPC ..... *H04R 25/40* (2013.01); *H04R 25/407* (2013.01); *H04R 25/552* (2013.01); *H04R 2225/43* (2013.01)

(58) Field of Classification Search
CPC .... H04R 25/40; H04R 25/405; H04R 25/407; H04R 25/43; H04R 25/552; H04R 2225/41; H04R 2225/43; H04R 2225/49; H04R 2430/20–2430/25
USPC ..... 381/23.1, 60, 71.11–71.14, 94.2, 94.3, 381/103, 312–331
See application file for complete search history.

(56) References Cited

U.S. PATENT DOCUMENTS 5,627,799 A * 5/1997 Hoshuyama ..... 367/121
6,603,861 B1 * 8/2003 Maisano et al. ..... 381/92

(Continued)

FOREIGN PATENT DOCUMENTS

EP 2211563 A1 7/2010

OTHER PUBLICATIONS

Puder, Henning, "Acoustic Noise Control: An Overview of Several Methods Based on Applications in Hearing Aids" Communications, Computers and Signal Processing, 2009, PACRIM 2009, IEEE Pacific RIM Conference on, IEEE, Piscataway, NJ, USA, Aug. 23, 2009, pp. 871-876.

(Continued)

*Primary Examiner* — Curtis Kuntz
*Assistant Examiner* — Joshua Kaufman
(74) *Attorney, Agent, or Firm* — Laurence A. Greenberg; Werner H. Stemer; Ralph E. Locher

(57) ABSTRACT

A method operates a hearing aid system and the hearing aid system has at least two hearing aid devices, between which a signal path is provided, and with at least one signal processing unit, which is provided to process audio signals. In the method the signal processing apparatus filters first audio signals with a filter predetermined for a defined spatial direction, from which a useful signal arrives, so that second audio signals are generated, in which the components of the useful signal in the second audio signals are equalized to a greater degree than in the first audio signals. The second audio signals are then filtered with an adaptive filter, so that third audio signals are generated, in which the components of the useful signal are equalized to an even greater degree than in the second audio signals.

12 Claims, 3 Drawing Sheets

(56) References Cited

U.S. PATENT DOCUMENTS

| | | | | |
|---|---|---|---|---|
| 6,751,325 | B1 * | 6/2004 | Fischer | 381/313 |
| 6,888,949 | B1 * | 5/2005 | Vanden Berghe et al. | 381/317 |
| 6,983,055 | B2 * | 1/2006 | Luo | 381/313 |
| 7,657,038 | B2 * | 2/2010 | Doclo et al. | 381/94.1 |
| 8,238,593 | B2 * | 8/2012 | Bisgaard et al. | 381/313 |
| 8,290,189 | B2 | 10/2012 | Kellermann et al. | |
| 8,553,901 | B2 * | 10/2013 | Hersbach | 381/71.6 |
| 8,638,960 | B2 * | 1/2014 | Gran et al. | 381/313 |
| 8,693,703 | B2 * | 4/2014 | Rung | 381/92 |
| 8,942,387 | B2 * | 1/2015 | Elko et al. | 381/94.2 |
| 2002/0041695 | A1 * | 4/2002 | Luo | 381/313 |
| 2004/0001598 | A1 * | 1/2004 | Balan et al. | 381/92 |
| 2005/0069162 | A1 * | 3/2005 | Haykin et al. | 381/312 |
| 2005/0094834 | A1 * | 5/2005 | Chalupper | 381/313 |
| 2005/0147258 | A1 * | 7/2005 | Myllyla et al. | 381/71.11 |
| 2008/0232607 | A1 * | 9/2008 | Tashev et al. | 381/71.11 |
| 2009/0304203 | A1 * | 12/2009 | Haykin et al. | 381/94.1 |
| 2010/0310084 | A1 * | 12/2010 | Hersbach | 381/71.6 |
| 2010/0329492 | A1 * | 12/2010 | Derleth et al. | 381/317 |
| 2013/0170680 | A1 * | 7/2013 | Gran et al. | 381/313 |
| 2014/0185849 | A1 * | 7/2014 | Ma et al. | 381/318 |
| 2014/0193009 | A1 * | 7/2014 | Yousefian Jazi et al. | 381/317 |

OTHER PUBLICATIONS

Teutsch, H., et al., "First and Second Order Adaptive Differential Microphone Arrays", in 7th International Workshop on Acoustic Echo and Noise Control (IWAENC 2001), pp. 35-38, Sep. 2001.

* cited by examiner

METHOD FOR ADJUSTING THE USEFUL SIGNAL IN BINAURAL HEARING AID SYSTEMS AND HEARING AID SYSTEM

CROSS-REFERENCE TO RELATED APPLICATION

This application claims the priority, under 35 U.S.C. §119, of German application DE 10 2013 207 161.2, filed Apr. 19, 2013; the prior application is herewith incorporated by reference in its entirety.

BACKGROUND OF THE INVENTION

Field of the Invention

The invention relates to a method for operating a hearing aid system, as well as a hearing aid system with at least two hearing aid devices, between which a signal path is provided, and with at least one signal processing unit, which is provided to process audio signals.

In many instances a hearing problem affects both ears and the person with impaired hearing should be provided with hearing devices for both ears (binaural). Modern hearing devices have signal processing algorithms, which vary the parameters of the hearing devices automatically as a function of the hearing situation. With binaural provision the hearing situation is evaluated at both ears.

Noise and interfering sounds are present everywhere in everyday life and impede voice communication, particularly when the natural hearing capacity is impaired. Technologies that suppress noise and interfering sounds but change the desired sounds and tones, also referred to in the following as useful signals, as little as possible are therefore desirable.

The known embodiments of technologies for suppressing noise and interfering sounds require signals with the most identical useful signal components possible for effective suppression of the interfering sounds. In practice however the different signals are acquired by a plurality of different microphones, which are disposed on both hearing aid devices. The useful signals acquired by the microphones differ significantly due to noise reverberation in the environment and the acoustic influence of the head of the wearer. This means that subsequent methods for suppressing interfering sounds do not operate effectively, particularly if they are adaptive methods, which only converge slowly or not at all. This results in poor suppression of the interfering sounds and additional acoustic artifacts due to the interfering sound suppression.

An adaptive method for suppressing interfering sounds is known for example from the publication by H. Teutsch, G. W. Elko "First- and Second-Order Adaptive Differential Microphone Arrays", 7th International Workshop on Acoustic Echo and Noise Control (IWAENC), pp. 35-38, Darmstadt, Germany September 2001, in which a least-mean-square (LMS) method is used to minimize interfering sounds.

A method for blind source separation using Wiener filters is known from the published, European patent application EP 2211563 A1, corresponding to U.S. Pat. No. 8,290,189.

SUMMARY OF THE INVENTION

It is the object of the present invention to create a method for operating a hearing device system as well as a hearing device system, by which interfering sound suppression is improved in binaural hearing aid systems.

The inventive method relates to a method for operating a hearing aid system with at least two hearing aid devices. The hearing aid devices have a transducer for receiving an acoustic signal and converting it in each instance to a first audio signal. The hearing aid system also has a signal processing apparatus for processing audio signals, as well as a signal connection for transmitting a first audio signal from each hearing aid device to the signal processing facility. The acoustic signal has a useful signal, which arrives from a defined spatial direction in relation to the hearing aid system. In the inventive method the signal processing apparatus processes the first audio signals with a filter predetermined for the defined spatial direction, so that second audio signals are generated, the predetermined filter being configured in such a manner that the components of the useful signal in the second audio signals are equalized to a greater degree than in the first audio signals. The second audio signals are filtered with an adaptive filter, so that third audio signals are generated, the adaptive filter being configured in such a manner that the components of the useful signal in the third audio signals are equalized to a greater degree than in the second audio signals.

In the first step the inventive method supplies second audio signals, in which the components of the useful signal are equalized to a greater degree than in the first audio signals. Therefore the adaptive filter of the second step advantageously converges much more quickly and therefore supplies third audio signals, in which the equalization of the useful signals is even further improved. This allows subsequent interfering sound suppression method based on these third audio signals to form better reference signals for the useful signal and interfering signal and to suppress interfering sounds almost completely. The preprocessing of the first audio signals in the predetermined filter means that the inventive method can allow shorter adaptive filters with a smaller computation capacity requirement and faster convergence of the adaptive filter, which advantageously allows adjustment to quickly changing ambient conditions.

The inventive hearing aid system for executing the inventive method shares the latter's advantages.

Advantageous developments of the method and hearing device system are set out in the sub claims.

Thus in one preferred embodiment of the invention the signal processing apparatus has means for dividing the first audio signals into first audio signals in predefined frequency ranges, the steps of the inventive method being executed separately for each audio signal in a frequency range.

This allows the predetermined filter and the adaptive filter to be optimized for the respective frequency range and the method to be integrated into the architecture of a hearing aid with frequency response correction according to the impairment of the patient.

In one possible embodiment the predetermined filter is defined by a predetermined number of predetermined coefficients.

A filter with a predetermined number of coefficients is simple to implement and advantageously requires only a small memory space.

In one embodiment it is conceivable for the predetermined number of predetermined coefficients to differ in different frequency ranges.

The computation capacity requirement can thus advantageously be optimized for the predetermined filter, in that more precise filtering only takes place in frequency ranges with corresponding interfering sounds. The memory requirement for the filter is also further reduced.

In one preferred embodiment predetermined coefficients for the predetermined filter are predetermined for at least two predetermined spatial directions.

It is therefore possible in a simple manner to switch the predetermined filter from a direction in which filtering takes place particularly effectively to another direction, if for example the source for the useful signal changes location.

In one preferred embodiment of the inventive method it also includes a step for estimating a spatial direction of the useful signal, the predetermined filter being predetermined by the coefficients, the assigned predetermined spatial direction of which is closest to the estimated spatial direction, in the step of filtering the first audio signals.

It is thus advantageously possible to set the predetermined filter for different predetermined spatial directions, the selected spatial direction in each instance being closest to the spatial direction of the source of the useful signal, so that the predetermined filter achieves an optimum filtering effect.

In one possible embodiment of the method a reference signal for an interfering sound is derived from the second and/or third audio signals by differentiation.

It is advantageous here that the components of the useful signal are already equalized to a greater degree in the second audio signals by the predetermined filter and in the third audio signals by the adaptive filter, so that they are almost completely canceled out by differentiation and a purer reference signal is supplied for the interfering sound. Subsequent methods for suppressing interfering sounds for example generate fewer artifacts and a purer useful signal when using the reference signals.

In one possible embodiment of the method a reference signal for a useful signal is derived from the second and/or third audio signals by totaling.

It is advantageous here that the components of the useful signal are already equalized to a greater degree in the second audio signals by the predetermined filter and in the third audio signals by the adaptive filter, so that a signal with an improved signal to noise ratio is available on addition.

In one possible embodiment of the inventive method the reference signal for a useful signal is used for detecting voice activity.

The improved signal to noise ratio means that the reference signal for the useful signal allows more reliable detection for example when used to detect voice activity (VAD, voice activity detection).

In one preferred embodiment of the inventive method the predetermined filter is a finite impulse response (FIR) filter.

An FIR filter advantageously has no tendency to oscillate and therefore ensures convergence of a supplied signal in all circumstances.

Other features which are considered as characteristic for the invention are set forth in the appended claims.

Although the invention is illustrated and described herein as embodied in a method for adjusting the useful signal in binaural hearing aid systems and a hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
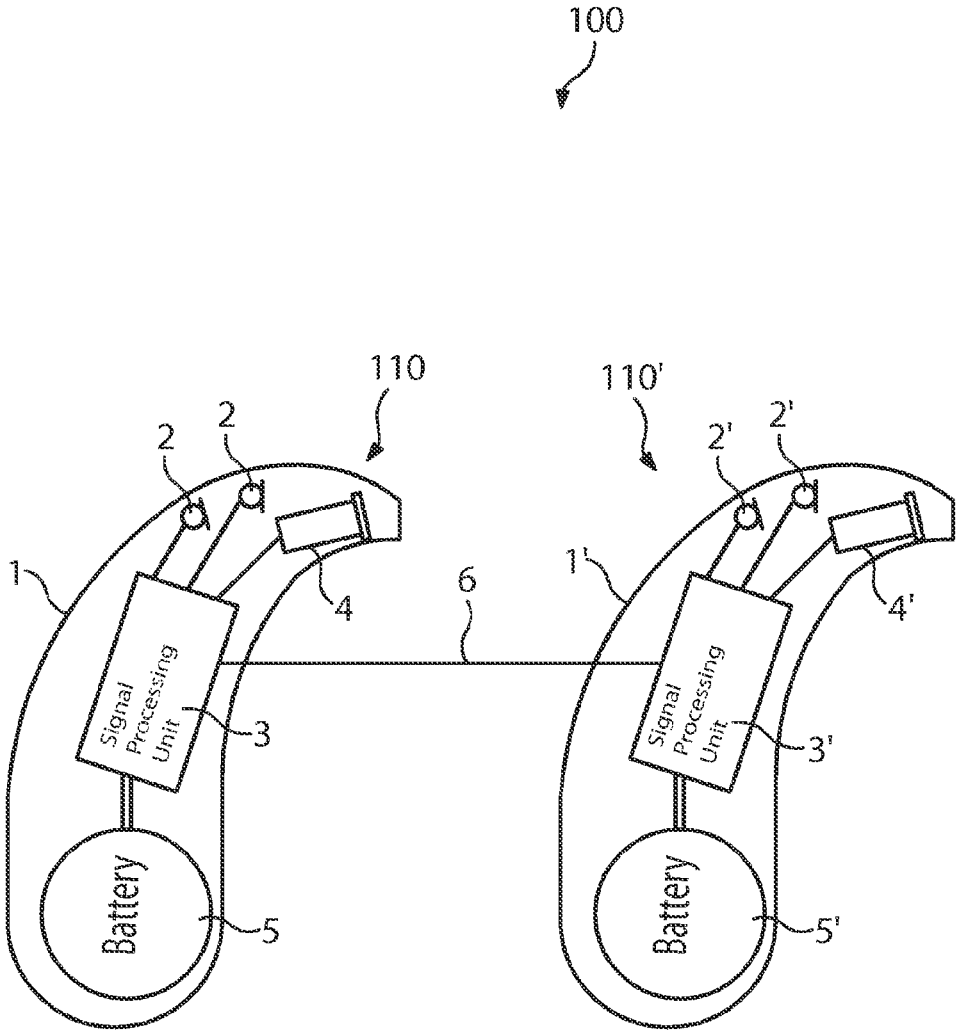
FIG. 1 is a schematic diagram of a hearing aid system according to the invention.

Referring now to the figures of the drawings in detail and first, particularly to FIG. 1 thereof, there is shown a basic structure of an inventive hearing aid system 100. The hearing aid system 100 has two hearing aid devices 110, 110". Integrated into a hearing device housing 1, 1" to be worn behind the ear are one or more microphones 2, 2" for receiving sound or acoustic signals from the environment. The microphones 2, 2" are transducers 2, 2" for converting the sound to first audio signals. A signal processing unit 3, 3", which is also integrated into the hearing device housing 1, 1", processes the first audio signals. The output signal of the signal processing unit 3, 3" is transmitted to a loudspeaker or earpiece 4, 4", which outputs an acoustic signal. In some instances the sound is transmitted by way of a sound tube, which is fixed with an otoplastic in the auditory canal, to the eardrum of the device wearer. Energy is supplied to the hearing device and in particular to the signal processing unit 3, 3" by a battery 5, 5", which is also integrated into the hearing device housing 1, 1".

The hearing aid system 100 also has a signal connection 6, which is configured to transmit a first acoustic signal from the signal processing facility 3 to the signal processing facility 3". In the preferred embodiment provision is made for signal processing facility 3" also to transmit a first acoustic signal in the counter direction to the signal processing facility 3. It is also conceivable to transmit the signals from several or all the microphones 2, 2" to the other hearing aid device 110, 110" in each instance.

The signal connection 6 can be a wired, optical or even wireless connection, e.g. Bluetooth.

Figure 2:
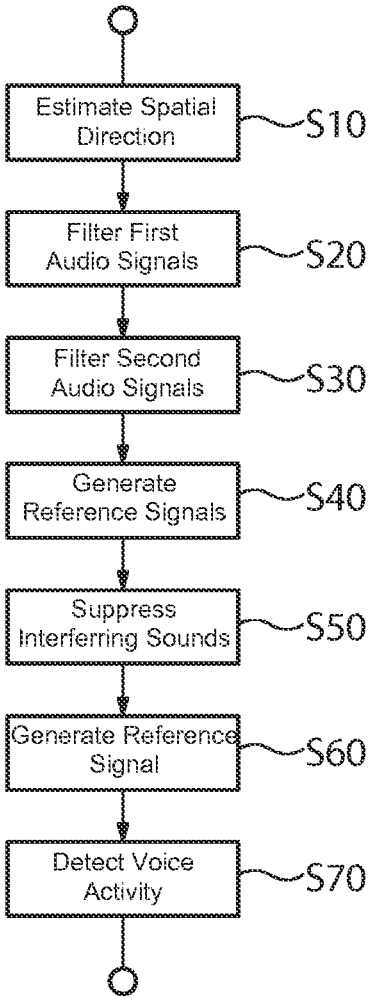
FIG. 2 is a flow diagram of an inventive method.

FIG. 2 shows a schematic flow diagram of an inventive method in the signal processing facility 3, 3".

In step S10 a spatial direction of a useful signal is estimated by the signal processing facility 3, 3'. This can be done for example by time or phase differences for a distinctive signal in the first audio signals. It is also possible to analyze the amplitude of this distinctive signal in the first audio signals. From the estimated spatial direction of the useful signal the signal apparatus selects a spatial direction from a number of predefined spatial directions, which is closest to the estimated spatial direction of the useful signal. If there is no distinctive signal present, an estimation of the spatial direction at an earlier time point is used or a predetermined direction is selected, e.g. in a straight line from the front of the face of the wearer of the hearing aid system. It is also conceivable only to re-estimate the spatial direction if a distinctive signal with identical features occurs more than once.

In step S20 the first audio signals are filtered by the predetermined filter 31. In this process the predetermined filter 31 uses predetermined filter coefficients for the defined spatial direction of the useful signal. For example a set of predetermined filter coefficients for the predetermined filter 31 can be stored in a look-up table for each element from the number of defined spatial directions. As a result of step S20 the predetermined filter 31 supplies second audio signals. In the second audio signals the useful signal is already equalized to a large degree as a signal component by the use of the predetermined filter 31, in other words the differences in amplitude and phase of the useful signal are smaller between the individual second audio signals than between the corresponding first audio signals. In real ambient conditions therefore compensation in the region of 5-10 dB can be achieved.

In step S30 the adaptive filter 32 filters the second audio signals. The adaptive filter used can be for example the least-mean-square (LMS) method for minimizing interfering sounds as described by Teutsch and Elko.

Prefiltering by means of the predetermined filter 31 means that the filter effect due to the adaptive filter 32 can be smaller. Therefore a filter with fewer coefficients can be used for example, with the result that an algorithm for the adaptive adjustment of the filter coefficients to the second audio signals converges more quickly.

As a result of step S30 the adaptive filter 32 supplies third audio signals. In these third audio signals the useful signal is already equalized to a large degree as a signal component by the use of the adaptive filter 32, in other words the differences in amplitude and phase of the useful signal are even smaller between the individual third audio signals than between the corresponding second audio signals.

In a step S40 in one conceivable embodiment a reference signal for an interfering sound can be formed by differentiating third audio signals, the reference signal being used in a step S50 by an interfering sound suppression method to suppress interfering sounds in the audio signals, before they are output by way of the earpiece 4 as acoustic signals. Filtering means that the useful signal in the different components of the third audio signal is almost identical, so that it is almost entirely canceled out with differentiation. Therefore subsequent interfering sound suppression methods produce scarcely any artifacts to distort the useful signal.

It is also conceivable for a reference signal for the useful signal to be generated in a step S60 by totaling third audio signals. As the components of the useful signal are equalized by filtering but the interference is statistically distributed, addition emphasizes the useful signal further compared to the interference. Therefore the reference signal for the useful signal obtained in step S60 has an improved signal to noise ratio and can be used in a further step S70 to detect voice activity.

Steps S10 to S70 can be applied to audio signals which have a single continuous frequency range. In one preferred embodiment however the first audio signals are first divided into different frequency ranges, before all or individual steps S10 to S70 are applied to the individual frequency ranges. This has the advantage that with a hearing aid for compensating for a patient's hearing problem different amplification and other signal processing, for example dynamic compression, are used for individual frequency ranges. Means for dividing the audio signals into frequency ranges are therefore generally already present and steps S10 to S70 can therefore be incorporated easily into the existing processing process. It is however also conceivable for individual steps, e.g. step S10 for estimating a defined spatial direction, to take place in a common manner for all frequencies.

Figure 3:
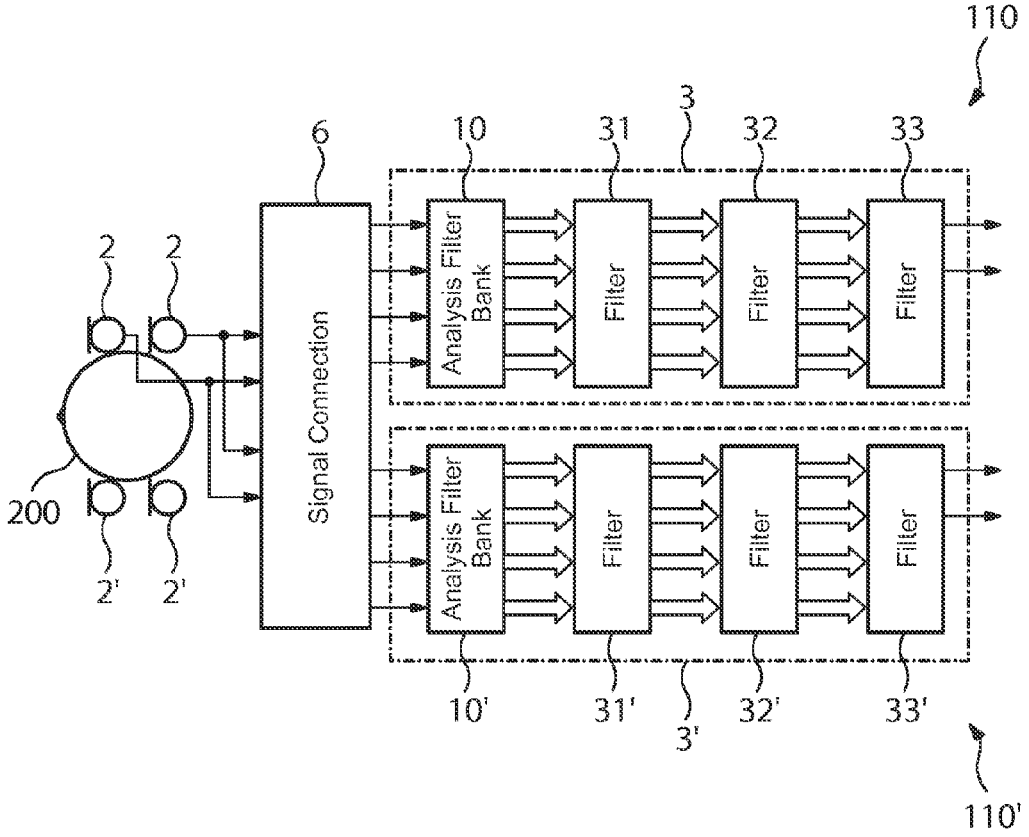
FIG. 3 is a block diagram showing function allocation in an embodiment of the binaural hearing aid system.

FIG. 3 shows a corresponding schematic diagram of an inventive hearing aid system 100 with frequency division.

The left side of FIG. 3 shows the head 200 of a patient with an arrangement of two microphones 2, 2' on each side of the head. The further function blocks are then no longer indicated in their position relative to the head.

The first audio signals of the microphones 2, 2' are fed by way of a signal connection 6 to both hearing aid devices 110, 110' and the signal processing facility 3, 3'. In an analysis filter bank 10, 10', which is configured in the signal processing units 3, 3', each of the four first audio signals in each hearing aid device 110, 110' is divided into a number of frequency bands. For the individual frequency ranges of the first audio signals the signal processing facility 3, 3' executes step S20, as illustrated by the function block of the predetermined filter 31, 31'. The second audio signals are fed to the adaptive filter 32, 32', which executes step S30 on the individual frequency ranges of the second audio signals and supplies third audio signals. Before conversion to acoustic signals, which are output by way of the earpieces 4, 4', synthesis of the individual frequency ranges of the third audio signals takes place in the synthesis filter bank 33, 33', so that four third audio signals result again, each with a single frequency range containing at least parts of the audible range.

The analysis filter bank 10, 10', which divides the first audio signals into frequency ranges, can be implemented for example by a short-time Fourier transform. The further processing of the second and third audio signals then takes place in the short-time Fourier domain, before they are combined back into an audio signal in the synthesis filter bank 33, 33' by means for example of an inverse short-time Fourier transform.

The allocation of the function blocks shown in FIG. 3 is only an example. It would also be conceivable therefore for the signal connection 6 not to be connected upstream of the signal processing unit 3, 3' but for the signal processing unit 3, 3' itself to supply protocols, signaling and interfaces, so that only the physical connection level of the signal connection 6 takes place outside the signal processing unit 3, 3'.

It would also be possible for the signal processing unit 3 of just one hearing aid device 110, 110' of the hearing aid system 100 to be designed to perform steps S10 to S70, while the other signal processing unit 3' is limited to supplying the first audio signals and transmitting the audio signals by way of the signal connection 6. It would thus be possible for example to avoid the power consumption required for parallel processing of all the signals in both hearing aid devices 110, 110'. Other architectures, for example with a central, offset signal processing unit 3, are also possible.

Figure 4:
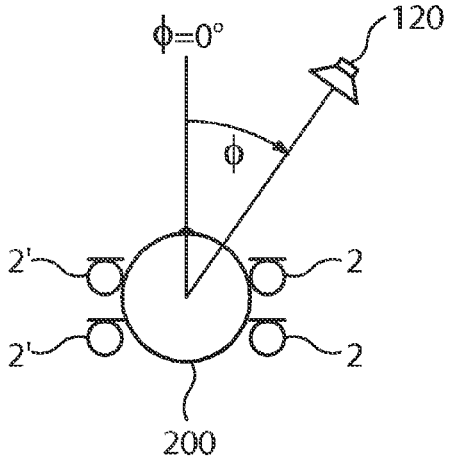
FIG. 4 is a schematic diagram of a test structure for determining direction-dependent predetermined filter coefficients.

FIG. 4 shows a further schematic diagram of a test structure for determining the direction-dependent predetermined filter coefficients. The filters 31 are predetermined, for example by predetermined filter coefficients. These filter coefficients can either be determined theoretically by a model calculation or can be determined in the laboratory by measurements and adaptive methods and stored in the signal processing unit 3, 3' using tables. FIG. 4 shows the artificial head 200 (e.g. KEMAR), on which the microphones 2, 2' are disposed. A non-illustrated measuring apparatus receives the audio signals of the microphones as a function of the spatial direction of a signal source 120 indicated by the angle $\phi$, the signal source emitting a useful signal in the form of sound. Modeling and optimization methods can then be used to determine a set of coefficients, which equalizes the components of the useful signal in the second audio signals for predetermined spatial directions in idealized measuring conditions. A spatial direction of a real useful signal source can be estimated in the hearing aid system 100 later by way of step S10 and in the predetermined filter 31 the corresponding coefficient set for a predetermined spatial direction closest to the estimated spatial direction can be selected and used for filtering. As real conditions are different from the ideal measuring conditions, equalization of the components of the useful signal in the second audio signals is not completely achieved, which is why the inventive method provides a subsequent adaptive filter 32, 32'.

Although the invention has been illustrated and described in detail by means of the preferred exemplary embodiment, the invention is not limited by the disclosed examples and other variations can be derived therefrom by the person skilled in the art, without departing from the scope of protection of the invention.

The invention claimed is:

1. A method for operating a hearing aid system with at least two hearing aid devices, one of the hearing aid devices provided for each ear of a user, the hearing aid devices each having a transducer for receiving an acoustic signal and converting the acoustic signal in each instance to a first audio signal, each of the hearing aid devices having a signal processing unit and a bidirectional exchange of the first audio signals taking place between the signal processing units of the hearing aid devices, the hearing aid system having a signal processing apparatus for processing audio signals and the hearing aid system having a signal connection for transmitting the first audio signal from each hearing aid device to the signal processing apparatus, wherein the signal processing apparatus executing the following steps for equalizing components of a useful signal in received audio signals of the acoustic signal in third audio signals, the useful signal arriving from a defined spatial direction in relation to the hearing aid system:

filtering first audio signals with a predetermined filter predetermined for the defined spatial direction, so that second audio signals are generated, the predetermined filter being configured in such a manner that the components of the useful signal in the second audio signals are equalized to a greater degree than in the first audio signals; and filtering the second audio signals with an adaptive filter, so that the third audio signals are generated, the adaptive filter being configured in such a manner that the components of the useful signal in the third audio signals are equalized to a greater degree than in the second audio signals.

2. The method according to claim 1, wherein the signal processing apparatus having means for dividing the first audio signals into predefined frequency ranges and the steps of claim 1 being executed separately for each audio signal in a frequency range.

3. The method according to claim 1, wherein the predetermined filter is defined by a predetermined number of predetermined coefficients.

4. The method according to claim 3, wherein the predetermined number of predetermined coefficients differing in different frequency ranges.

5. The method according to claim 3, wherein the predetermined coefficients for the predetermined filter being predetermined for at least two predetermined spatial directions.

6. The method according to claim 5, which further comprises performing the following steps in the step of filtering the first audio signals:

estimating an estimated spatial direction of the useful signal; and assigning the predetermined filter with the predetermined coefficients of a predetermined spatial direction which is closest to the estimated spatial direction.

7. The method according to claim 1, which further comprises deriving a reference signal for an interfering sound from the second and/or third audio signals by differentiation.

8. The method according to claim 1, which further comprises deriving a reference signal for the useful signal from the second and/or third audio signals by totaling.

9. The method according to claim 8, which further comprises using the reference signal for the useful signal for detecting voice activity.

10. The method according to claim 1, wherein the predetermined filter is a finite impulse response (FIR) filter.

11. The method according to claim 1, wherein the adaptive filter uses a least-mean-square (LMS) method for minimizing interfering sounds.

12. A hearing aid system, comprising:

two hearing aid devices each having a transducer for receiving an acoustic signal and converting the acoustic signal in each instance to a first audio signal, one of said hearing aid devices provided for each ear of a user;

each of said hearing aid devices having a signal processing apparatus for processing audio signals and having a predetermined filter and an adaptive filter;

a signal connection for bi-directionally exchanging the first audio signals between said signal processing apparatuses of said hearing aid devices; and the hearing aid system configured to execute the following steps:

filter first audio signals with said predetermined filter predetermined for a defined spatial direction, so that second audio signals are generated, said predetermined filter configured in such a manner that components of a useful signal in the second audio signals are equalized to a greater degree than in the first audio signals; and filtering the second audio signals with said adaptive filter, so that third audio signals are generated, said adaptive filter configured in such a manner that components of the useful signal in the third audio signals are equalized to a greater degree than in the second audio signals.

* * * * *